US005283919A

United States Patent [19]

Grant

[11] Patent Number: 5,283,919

[45] Date of Patent: Feb. 8, 1994

[54] FOLDING TRAUMA STRETCHER

[76] Inventor: Fred W. Grant, 3177 Terrace Ct., Apt. H, Norcross, Ga. 30092

[21] Appl. No.: 800,289

[22] Filed: Nov. 29, 1991

[51] Int. Cl.[5] ..... A47C 19/12

[52] U.S. Cl. ..... 5/620; 5/176.1; 5/81.1

[58] Field of Search ..... 5/620, 627, 600, 201, 5/174, 176.1, 177, 116, 117

[56] References Cited

U.S. PATENT DOCUMENTS

| | | | |
|---|---|---|---|
| 1,129 | 4/1839 | Fountain | 5/176.1 |
| 531,471 | 12/1894 | Shaw | 5/620 |
| 614,176 | 11/1898 | Murray | 5/81.1 |
| 715,370 | 12/1902 | Hagedorn | 5/117 |
| 1,146,802 | 7/1915 | Kozak | 5/627 |
| 1,453,504 | 5/1923 | Janisch | 5/620 |
| 1,483,607 | 2/1924 | Liedtke | 5/627 |
| 1,577,205 | 3/1926 | Davis | 5/117 |
| 2,133,692 | 10/1938 | Gittings | 5/627 |
| 2,596,250 | 5/1952 | Klingler | 5/81.1 |
| 2,781,525 | 2/1957 | Bauer | 5/81.1 |
| 4,243,263 | 1/1981 | Thiboutot | 5/176.1 |

FOREIGN PATENT DOCUMENTS

| | | | |
|---|---|---|---|
| 1118358 | 1/1955 | France | 5/174 |

*Primary Examiner*—Renee S. Luebke
*Assistant Examiner*—F. Saether
*Attorney, Agent, or Firm*—Hopkins & Thomas

[57] ABSTRACT

A folding trauma stretcher (10) having two rectangular frame assemblies (11 and 12) hingedly mounted together and supported by four legs pivotally mounted to the frame members, wherein the frame members are adapted to fold inward into a compact configuration for storage. The stretcher (10) includes a support structure for securing the stretcher in an open, unfolded position, the structure including brace arms (74 and 75) for preventing the legs from pivoting with respect to the frame assemblies and a stop plate (52) and locking means (87) for preventing the frame members from pivoting with respect to each other.

4 Claims, 3 Drawing Sheets

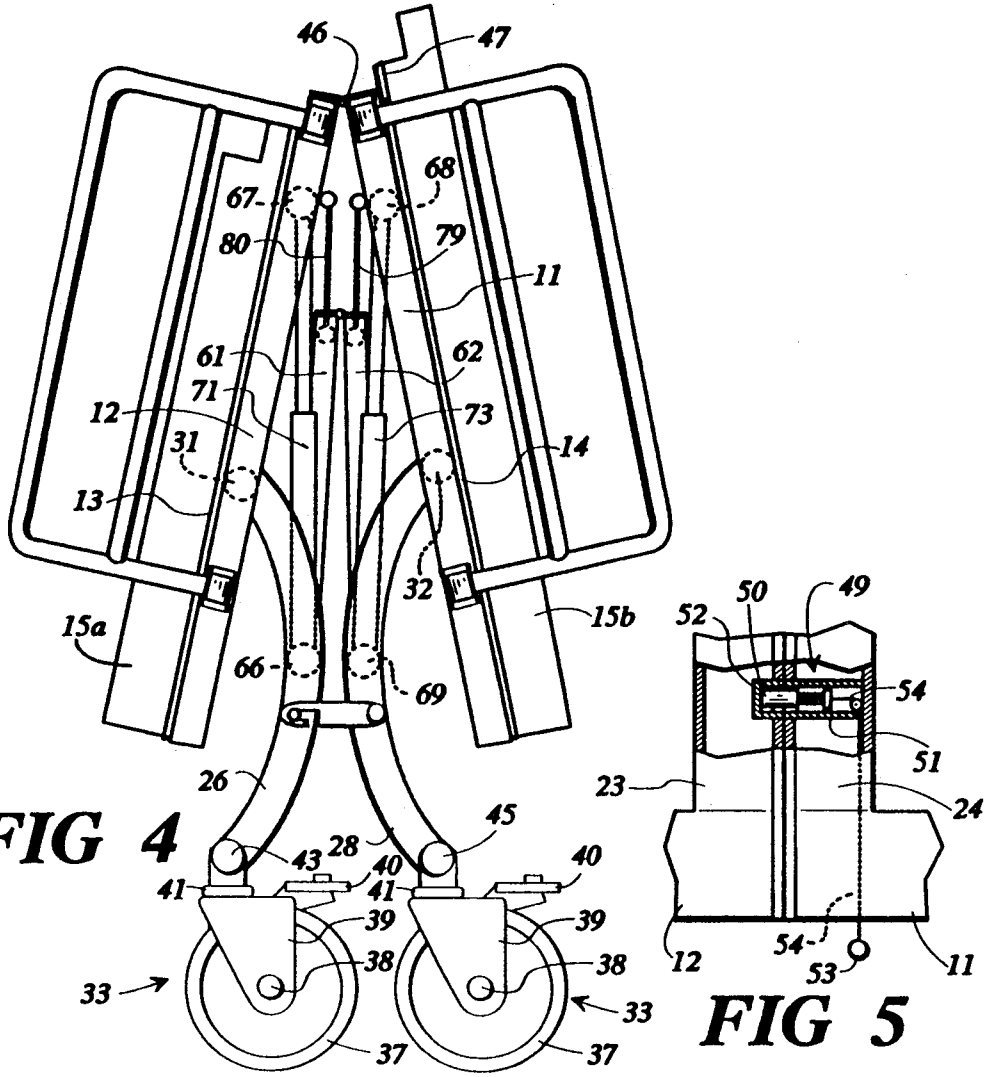
FIG 4
FIG 5
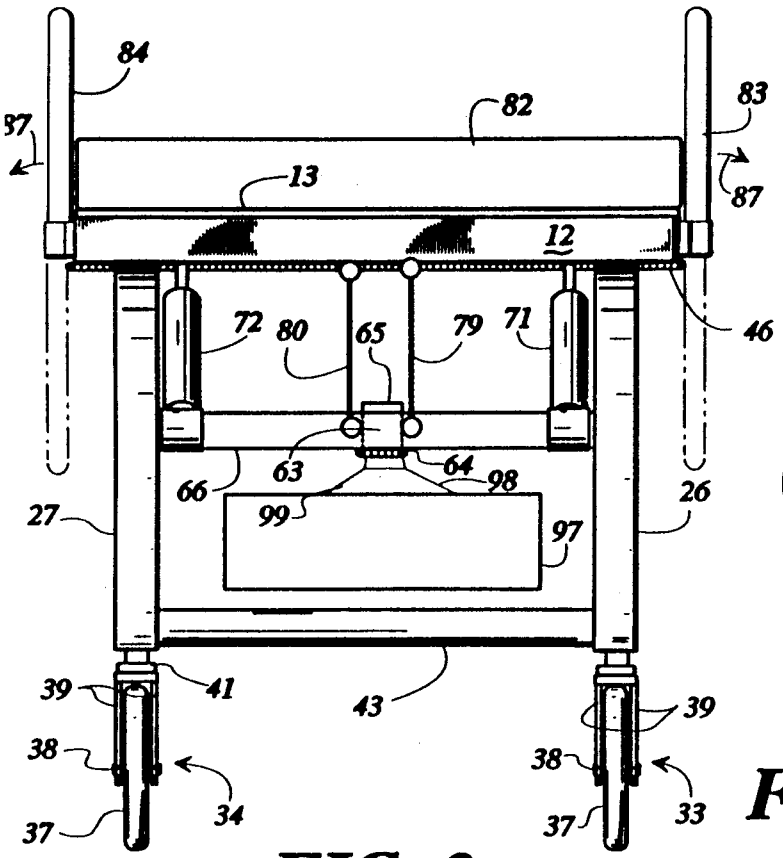
FIG 3

FOLDING TRAUMA STRETCHER

FIELD OF THE INVENTION

The present invention relates to stretchers, sometimes referred to as litters, of the type used to transport an injured person in a prone position, such stretchers being commonly known as "trauma stretchers."

BACKGROUND OF THE INVENTION

Hospitals, nursing homes and other health care centers often use mobile trauma stretchers in order to transport injured persons. Typically such stretchers include a patient support platform, a set of legs for maintaining the platform at a height sufficient to allow medical personnel to attend to the person lying on the stretcher, and a set of wheels for making it easy to move the stretcher. Some stretchers known in the art include legs that are collapsible so that the stretcher can fit inside an ambulance. While these types of stretchers perform well for transporting people, storing them when they are not in use can be a problem. Such stretchers, even the ones with collapsible legs, take up a considerable amount of space, which can be a problem for emergency centers, for example, that need to have a great number of them on hand at all times, and yet are usually limited as to space.

SUMMARY OF THE INVENTION

Briefly described, the present invention comprises a trauma stretcher including first and second substantially identical platform assemblies hinged together at their adjacent or inner ends and which, when in open horizontal operative positions, form a substantially flat patient supporting bed. When the trauma stretcher is not in use, it can be folded to a shorter configuration by raising the inner ends of the platform assemblies so that the platform assemblies are reoriented to almost upright attitudes. Depending from each platform is a pair of support legs having wheels at their lower ends, with each pair of support legs being pivotally connected at their upper ends to the platform. When the stretcher is open, locking means lock the platform members in the open horizontal position, and the legs are held in upright attitudes by a pair of hinged bracing members extending longitudinally of the stretcher between the legs of the respective platform members and hinged together at their adjacent ends. The bracing members function to maintain the support legs in upright attitudes and to restrain the legs from folding outwardly beyond or inwardly beneath the stretcher.

A linkage extends between the adjacent ends of the bracing members and the adjacent ends of the platform assemblies so that when the adjacent ends of the platform assemblies are pivoted upwardly toward their folded positions the linkage likewise lifts the adjacent ends of the bracing members so that they pivot upwardly toward a folded position, thereby drawing the support legs together with the platform members straddling the legs.

The stretcher also includes a set of side bars mounted at the sides of the platform members for preventing a patient from falling off the stretcher and which are positioned so that they do not interfere with each other when the stretcher is folded. The stretcher also is provided with a removable caddy suspended beneath the patient support platform assemblies for carrying accessories such as an IV rod, oxygen tank holder and other items, in a manner in which the caddy can be easily removed from the stretcher so that it does not interfere with folding the stretcher.

Therefore, it is an object of the present invention to provide a reliable and safe foldable trauma stretcher that takes up a minimal amount of space when folded and stored or not in use.

Another object of the invention is to provide a foldable trauma stretcher with features that common stretchers include, which do not interfere with the folding feature of the trauma stretcher.

Other objects, features and advantages of the present invention will become apparent from reading the following specification, when taken in conjunction with the accompanying drawings.

BRIEF DESCRIPTION OF THE DRAWINGS

FIG. 3 is an end elevational view of the stretcher illustrating the legs, the lateral cross-braces reinforcing the legs and the foldable support framework.

FIG. 4 is a side elevational view of the stretcher of the invention illustrating the stretcher in a folded, storage configuration; and FIG. 5 is a diagrammatic plan view of the means for locking the stretcher in its down, open position.

DETAILED DESCRIPTION

Figure 1:
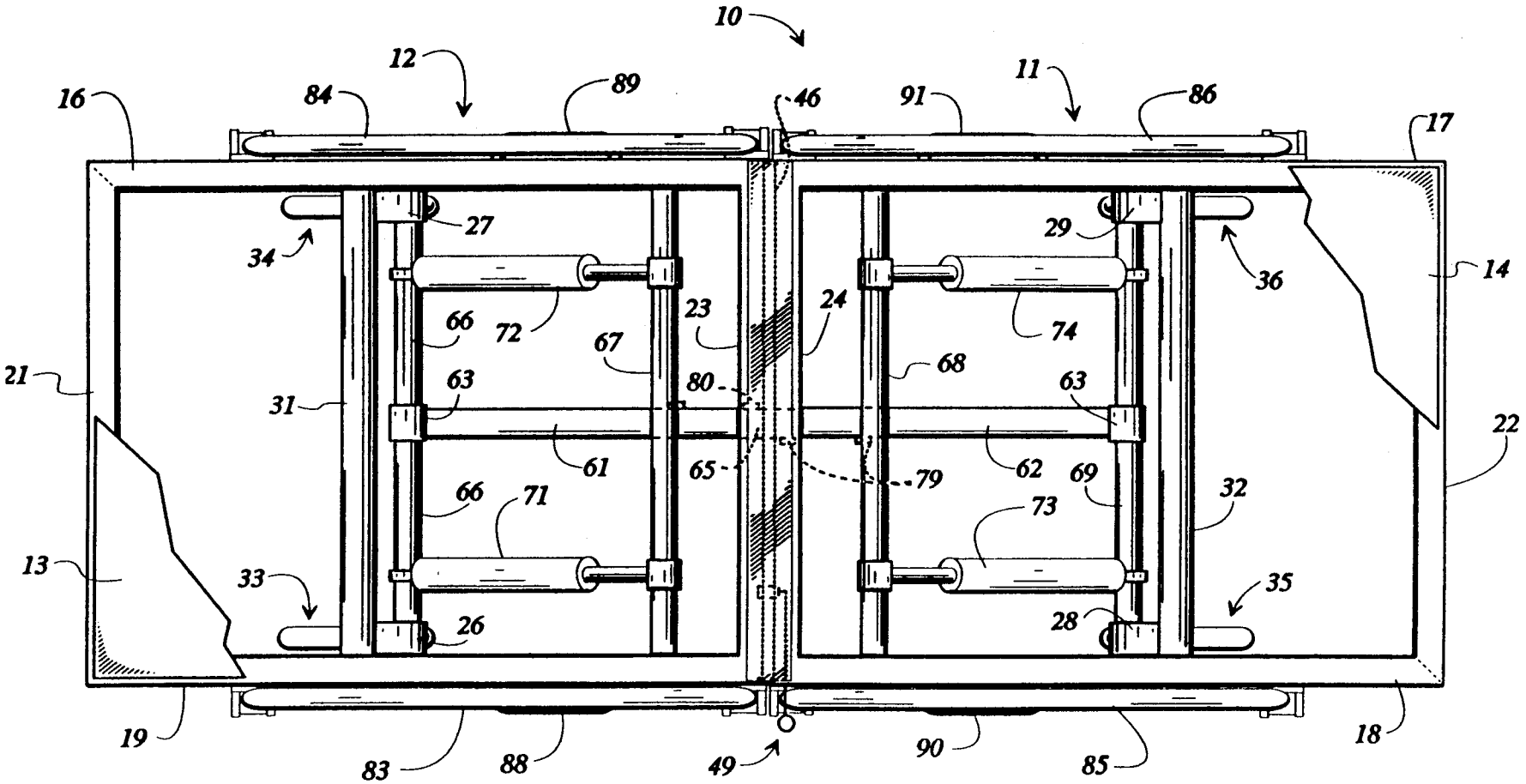
FIG. 1 is plan view of the folding trauma stretcher with the padding and the top patient support platforms partially removed, illustrating the patient support frame assemblies which support the patient support platforms, and the foldable support framework positioned below the patient support frame assemblies.
Figure 2:
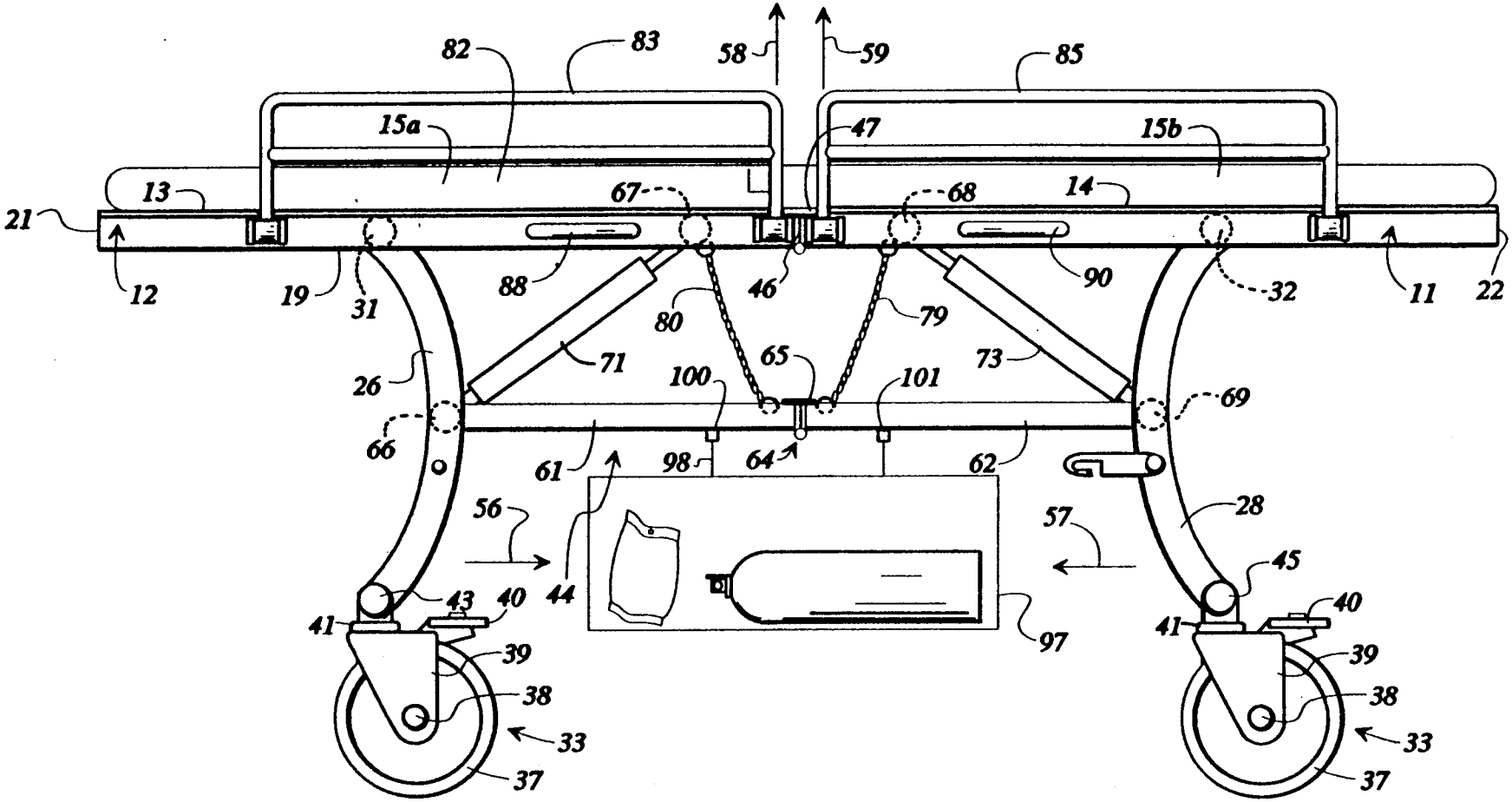
FIG. 2 is a side elevational view of the folding trauma stretcher illustrating the legs, wheels, and the linkages which comprise the foldable support framework of the stretcher.

Referring now in more detail to the drawings, in which like numerals represent like parts throughout the several views, FIG. 1 is a plan view of a foldable trauma stretcher 10 in a preferred embodiment thereof in an unfolded, operative configuration. Stretcher 10 comprises rectangular platform frame assemblies 11 and 12 which have longitudinal side rails 16, 17 and 18 , 19 respectively, forming the sides of stretcher 10. Lateral end rails 21 and 22 form the outer ends of the frame assemblies 11 and 12, respectively, and centrally positioned lateral inner rails 23, 24 form the inner ends of frame assemblies 11 and 12, respectively. As shown in FIG. 2, mounted on the top edges of frame assemblies 11, 12 are rigid platforms 13, 14, which support pads 15*a* and 15*b*, thereby forming a patient supporting bed.

As best shown in FIGS. 2 and 3, frame assemblies 11 and 12 in the operative position are supported by four support legs such as legs 26, 27, 28, and 29, arranged in a rectangular relationship at opposed sides and ends of the stretcher 10 and which are joined to pivot axles 31 and 32. These pivot axles, in turn, are rotatably mounted to, and extend between, longitudinal side rails 16, 19 and 17, 18, respectively, of frame assemblies 11 and 12. The pivotal connection of the legs to the platforms insures that the legs remain in an upright position when stretcher 10 is folded into its storage position, as shown in FIG. 4, thereby making the folded stretcher extremely compact. The legs are movably supported by four wheel assemblies 33, 34, 35, and 36, each wheel assembly comprising a wheel 37 mounted on an axle 38, which is mounted to a wheel support clevis 39 (FIG. 2), a swivel mount 41 mounted between the support clevis 39 and the leg of each respective wheel assembly for swivelly supporting each leg, and a brake means 40 pivotally mounted to each support clevis 39 and adapted to engage and to brake wheel 37 when depressed, preferably by the foot of an operator. Wheel assemblies 33, 34, 35 and 36, as well as brake means 40, are well known in the art, and preferrably are of a type of swivel caster, such as Model Series 56 or 60 manufactured by Jarvis Caster Group, Palmer, Mass., U.S.A. As shown in FIGS. 2 and 3, cross braces 43 and 45 are mounted to, and extend between, the pairs of support legs 26, 27 and 28, 29, respectively, and reinforce the legs. The height of the support legs is sufficient, when the stretcher is in its operative or open position, to allow medical personnel to attend to a person lying on the stretcher. It also should be noted that the support legs are crescent shaped for reasons which shall be explained hereinafter.

As shown in FIG. 1, lateral inner rails 23, 24, forming the inner ends of frame assemblies 11, 12, are pivotally joined by a piano-type hinge 46, which extends the entire length of inner rails 23 and 24. Thus, as shown in FIG. 2, when stretcher 10 is folded, frame assemblies 11 and 12 move upwardly in the direction of arrows 58 and 59 as hinge 46 opens up, and legs 26 and 27 move in the direction of arrow 56 while legs 28 and 29 move in the direction of arrow 57.

When the stretcher is used to transport a patient, it is important, from a safety standpoint, that the stretcher be structurally sound enough not only to support the weight of the patient but also to resist any forces that may act upon the ends, sides or underside of the stretcher. Consequently, the stretcher includes a support framework 44, including linkages, bracing members and stop plates, which secure the frame assemblies 11, 12 and legs 26, 27, 28 and 29 when the stretcher is in its open position. The support framework 44, which shall be more fully discussed hereinafter, prevents frame assemblies 11,12 from pivoting with respect to each other and prevents the legs from pivoting with respect to the frame assemblies, thereby preventing the open stretcher from collapsing.

As shown in FIG. 2, the first part of this support framework 44 is a stop plate 47, which is mounted along the top of lateral inner rail 24 and extends longitudinally above the top edges of hinge 46 and lateral inner rail 23 when the stretcher is in the open position. Stop plate 47 prevents any tendency of lateral inner rails 23, 24 to pivot downwardly, thereby serving to maintain the frame assemblies in fixed position with respect to each other and reinforce the stretcher 10 at its center and to relieve some of the stress on hinge 46.

As shown in FIG. 5, stretcher 10 also includes a lock 49, which functions as a locking means, for maintaining frame assemblies 11, 12 in fixed position with respect to each other when the stretcher is in use, which prevents the frame assemblies 11, 12 from pivoting upwardly, as might occur, for example, by a person sitting or leaning on one end of the stretcher. Other locking devices known to those skilled in the art may be suitable for locking the stretcher in its open position. In the preferred embodiment, lock 49 comprises a latch 50 connected to a spring 51 which biases latch 50 into a slot 52 within lateral inner rail 23. Latch 50 is beveled on its under side and flat on top, much like the latch of a common door knob, thus, as frame assemblies 11 and 12 are unfolded from an upright, folded position to a horizontal, open position, the beveled underside of latch 50 extended outwardly from lateral inner rail 24 engages hinge 46 and is urged inwardly toward lateral inner rail 24. When the lateral inner rails 23, 24 and hinge 46 mate, latch 50 is urged into slot 52 by spring 51. In order to release latch 50 from slot 52, a knob 53 connected to cable 54 can be pulled causing cable 54 to remove latch 50 from within slot 52, which action compresses spring 51.

Due to the legs 26, 27, 28, and 29 and axles 31 and 32 being pivotally connected to platform frame assemblies 11, 12, the legs would tend to pivot outwardly from or inwardly toward the inner rails 23, 24 of the stretcher when a patient is placed on the stretcher. In order to prevent this, a pair of brace arms 61 and 62 (FIG. 2) are pivotally mounted perpendicularly at one of their ends to the lateral center points 63, as shown in FIGS. 1 and 3, of a pair of pivot axles 66 and 69, which are mounted to, and extend laterally between, legs 26, 27 and 28, 29, respectively. As shown in FIG. 2, brace arms 61 and 62 are pivotally hinged together at their other ends by hinge 64. Hence, brace arms 61 and 62 function as a means for maintaining the legs in fixed position with respect to frame assemblies 11, 12 when the frame assemblies are secured by lock 49. Brace arm 62 has mounted to its inner end a stop plate 65 which engages the upper surface of brace arm 61 when the brace arms 61 and 62 are folded down to their horizontal attitudes, which prevents the brace arms from collapsing and serves to reinforce the center of the stretcher in a manner similar to that of stop plate 47.

Brace arms 61, 62, pivotally coupled together by hinge 64, as previously stated, are linked to frame assemblies 11, 12 by a pair of flexible pull chains 79, 80. Hinge 64 allows brace arms 61 and 62 to pivot upwardly when the stretcher 10 is folded. Flexible pull chains 79, 80 are mounted to frame assemblies 11, 12 and to brace arms 61, 62, and pull upwardly on brace arms 61 and 62 when the inner rails 23, 24 of assemblies 11 and 12 are pivoted upwardly. Thus, pull chains 79 and 80 function as a means for causing brace arms 61 and 62 to pivot relative to each other when said frame assemblies pivot from an open position to a folded position, such means being responsive to the upward folding movement of the frame assemblies for upwardly folding said brace members. It should be noted that pull chain 79 is mounted laterally on one side of brace arms 61 and 62 and pull chain 80 is mounted laterally on the other side of brace arms 61 and 62, as seen in FIGS. 1 and 3. With brace arms 61, 62, stop plates 47, 65 and lock 49 acting in unison, they function as a means for securing the stretcher in its open position.

As shown in FIG. 2, the stretcher also includes piston/cylinder assemblies 71, 72, 73 and 74 pivotally mounted to pivot axles 66, 67, 68 and 69, axles 67 and 68 being mounted to, and extending between, longitudinal side rails 16, 19 and 17, 18, respectively. The piston/cylinders 71 through 74 are fully retracted when the stretcher is in its open position and thereby serve as a means for maintaining the legs in a fixed position with respect to the frame assemblies. As the stretcher is folded inwardly, the piston/cylinders 71 through 74 distend, as shown in FIG. 4, to control the angular relationship between the frame assemblies and the legs by imparting a resistance to the pivoting movement therebetween. In a preferred embodiment, the piston/cylinders are air filled to provide an air cushion to support framework 44, thus cushioning the apparatus during folding and unfolding.

When the stretcher is folded, frame assemblies 11, 12 pivot upwardly, as shown by arrows 58 and 59 in FIG. 2, thereby pulling on pull chains 79 and 80, which in turn pull brace arms 61 and 62 upwardly, causing bracing arms 61 and 62 to pivot about hinge 64. Piston/cylinder assemblies 71 through 74 then distend to the extent shown in FIG. 4. Legs 26 through 29 are crescent shaped so that pivot axles 66 and 69 are spaced longitudinally inwardly from pivot axles 31 and 32 towards the center of the stretcher 10. The offset allows piston/cylinders 71 through 74 to extend fully without striking the undersides of frame assemblies 11, 12 when the stretcher is completely folded inward.

Frame assemblies 11, 12 also include fold down side bars 83, 84, 85 and 86 pivotally mounted to longitudinal side rails 16, 17, 18 and 19 and adapted to pivot in the direction of arrows 87 as shown in FIG. 3. Frame assemblies 11, 12 also include handles 88, 89, 90 and 91 mounted to the longitudinal side rails. Inasmuch as the legs 26, 27, 28, and 29 and the structure of the support framework 44 are inside the lateral limits of the stretcher as defined by side rails 16, 17, 18, and 19, there can be no interference between them and the side bars and handles during folding and unfolding of the stretcher. A purpose of the side bars is to prevent a patient from falling off of the stretcher, while a purpose of the handles is to allow medical personnel to push the stretcher while walking adjacent the sides thereof, and to allow such personnel to fold the stretcher into its storage configuration.

The stretcher also may include a caddy which can be in the form of an open wire basket 97 which is suspended by cables 98 and 99 which are removably suspended from hooks 100 and 101 mounted to the under side of brace arms 61, 62, (FIG. 2). Basket 97 supports many accessory items such as an IV rod and oxygen tank, and can be removed from the stretcher prior to folding by unhooking cables 98, 99 from hooks 100, 101.

It will be understood that the foregoing relates only to a preferred embodiment of the present invention, and that numerous changes and modifications may be made therein without departing from the spirit and scope of the invention as set forth in the following claims.

I claim:

1. A foldable stretcher having an open position for transporting a patent and a folded position for storing the stretcher, said stretcher comprising:

first and second juxtaposed frame assemblies each having an adjacent end;

said frame assemblies including patient support means for providing a flat surface for supporting a patient;

a hinge pivotally joining said frame assemblies at their adjacent ends for allowing the adjacent ends of said frame assemblies to pivot upward from an open horizontal position to a folded position;

frame support means for supporting said frame assemblies, said frame support means comprising a first pair of spaced legs pivotally mounted to said first frame assembly and a second pair of legs pivotally mounted to said second frame assembly;

securing means for securing said stretcher in the open position, said securing means comprising means for maintaining said frame assemblies in fixed horizontal positions with respect to one another and means for maintaining said legs in a fixed position with respect to said frame assemblies when said frame assemblies are in their fixed horizontal positions, comprising first and second brace arms each having a first and a second end, said first end of said first brace arm being pivotally coupled to said first pair of legs and said first end of said second brace arm being pivotally connected to said second pair of legs, a hinge for pivotally connecting together said second ends of said brace arms; and means for maintaining said brace arms in fixed position with respect to each other;

said means for maintaining said legs in fixed position with respect to said frame assemblies further comprising a first piston/cylinder and a second piston/cylinder each having a first end and a second end, said first end of said first piston/cylinder being pivotally coupled to said first pair of legs and said second end of said first piston/cylinder being pivotally coupled to said first frame assembly adjacent said adjacent end thereof, said first end of said second piston/cylinder being pivotally coupled to said second pair of legs and said second end of said second piston/cylinder being pivotally coupled to said second frame assembly adjacent said adjacent end thereof, wherein said piston/cylinders are retracted when said stretcher is in the operative position.

2. A foldable stretcher as claimed in claim 1 wherein a first pivot axle extends between said first pair of legs and a second pivot axle extends between said second pair of legs, and a third pivot axle is mounted to said first frame assembly and a fourth pivot axle is mounted to said second frame assembly, said first end of said first piston/cylinder being coupled to said first pivot axle and said second end of said first piston/cylinder being coupled to said third pivot axle, and said first end of said second piston/cylinder being coupled to said second pivot axle and said second end of said second piston/cylinder being coupled to said fourth pivot axle.

3. A foldable stretcher as claimed in claim 1 and further comprising a third and a fourth piston/cylinder, each having a first end and a second end, said first end of said third piston/cylinder being pivotally coupled to said first pair of legs and said second end of said third piston/cylinder being pivotally coupled to said first frame assembly, said first end of said fourth piston/cylinder being pivotally coupled to said second pair of legs and said second end of said fourth piston/cylinder being pivotally coupled to said second frame assembly.

4. A foldable stretcher as claim ed in claim 1 wherein each of said piston/cylinder is air filled.

* * * * *